United States Patent [19]

Edwards et al.

[11] 4,191,077

[45] Mar. 4, 1980

[54] BEARING BLOCK WITH AIR SUPPLY PASSAGE

[75] Inventors: Richard L. Edwards, Windsor Locks; Martin Kesten, West Hartford, both of Conn.

[73] Assignee: Preston Engravers, Inc., Windsor, Conn.

[21] Appl. No.: 972,894

[22] Filed: Dec. 26, 1978

[51] Int. Cl.[2] ..... B26D 7/06

[52] U.S. Cl. ..... 83/99; 83/669

[58] Field of Search ..... 83/98, 99, 100, 669, 83/346, 347; 29/113 R, 113 AD

[56] References Cited

U.S. PATENT DOCUMENTS

| | | | |
|---|---|---|---|
| 338,769 | 3/1886 | Osborne . | |
| 3,457,617 | 7/1969 | Noe et al. | 29/113 |
| 3,534,681 | 10/1970 | Beals | 101/37 |
| 3,766,814 | 10/1973 | Kesten | 83/99 |
| 4,062,096 | 12/1977 | Eibe | 29/113 AD |

*Primary Examiner*—J. M. Meister

[57] ABSTRACT

A bearing-block body member in which a die-cutting roll is journaled includes an adjusting cap seated in it through which a bore extends axially of the roll. An axial chamber is provided in the roll, and a stationary air manifold extends into the chamber, permitting relative rotation between the roll and the manifold. An air tube having an axial portion and a transverse portion has its axial portion extending through the bore in the adjusting cap to couple with the manifold so as to hold it in rotational position but permit axial withdrawal. Fluid communication is provided between the air tube and the manifold, and corresponding ports in the manifold and apertures in the die register periodically to permit air to flow from the air tube through the manifold, the ports, and the apertures to the outer surface of the roll. As a result of this arrangement, air can be supplied transversely of the axis of the roll, but ready removal of the roll and the manifold is afforded.

9 Claims, 6 Drawing Figures

BEARING BLOCK WITH AIR SUPPLY PASSAGE

BACKGROUND OF THE INVENTION

The present invention relates generally to systems for providing fluid to rotating dies, and it finds particular application as an apparatus for suppling air to a die-cutting roll.

In a U.S. Patent to Kesten, No. 3,766,814 and air-eject die-cutting assembly was described in which air was suppled internally into a die-cutting roll for the purpose of freeing the die-cutting surfaces of the roll of scrapes that resulted from the cutting. That specification is hereby incorporated by reference.

Generally speaking, the previous Kesten arrangement included a cylindrical roll having radial apertures leading from an axial chamber to the surface of the roll. A manifold extended into the chamber of the roll and had radial openings for registry with the apertures in the roll. The manifold was stationary, and the roll rotated around the manifold. This caused air to be supplied to the outside surface of the cylinder through the apertures at regular intervals, whenever the openings in the manifold registered with apertures in the roll. This was a particularly advantageous arrangement because it permitted high-pressure air to be supplied to the surface only when needed, thereby greatly reducing the total volume of air required.

The roll of the U.S. Pat. No. 3,766,814 arrangement was intended to be easily removed from mounting in the press in which it was journaled. Typically, the air was supplied by means of a hose attached to a nipple that extended axially from the manifold. When it was desired to change dies, the hose was merely removed, and the assembly including the roll and the manifold were withdrawn from their position mounted in the press.

This arrangement, as was noted above, is quite advantageous and presented a significant step forward in the art. However, though the principle of U.S. Pat. No. 3,766,814 remains quite workable, and the specific embodiment illustrated therein can be readily applied in most instances, there exist applications to which the specific arrangement illustrated in U.S. Pat. No. 3,766,814 is not well suited. Specifically, it has been found that some presses are so arranged that access to the manifold to supply air axially of the roll is not available, and it is necessary to bring the air in from a direction generally transverse to the axis of the roll and manifold. This would at first appear to present no particular problem, because the manifold is stationary, but a closer consideration of the problem reveals that an arrangement in which the air is supplied in a direction generally transverse to the access of the manifold will not afford easy replacement of the roll-and-manifold assembly in the bearing block and press. Accordingly, a need was present in the prior art for an arrangement in which the air could be supplied transversely but ready substitution of the roll-and-manifold assembly was afforded.

SUMMARY OF THE INVENTION

It has now been found that the foregoing and related objects may be readily attained by a die-cutting roll assembly for use in die-cutting press. The die-cutting roll assembly includes a die-cutting roll having a cylindrical cavity extending axially inwardly from one end thereof and having mounting means on the other end therof adapted to be rotatably supported in the press. The roll has at least one aperture extending generally radially from the cavity to a location on the outside surface of the roll, the aperture enabling fluid flow between the cavity and the outside surface of the roll and comprising substantially the only outlet for fluid from the roll.

A generally cylindrical fluid-delivery manifold extends axially into the cavity from the one end of the roll for relative rotation therebetween. The roll prevents axial motion of the manifold with respect to the roll in the direction away from the one end of the roll. The manifold is dimensioned and configured to seat in the cavity with its outer surface in close proximity to the inner surface of the roll that defines the corresponding portion of the cavity. The manifold has an axially extending passageway therein with an outlet comprising at least one generally radially extending port opening at a point on the outer surface thereof in a location for registry with the one aperture of the roll to permit fluid flow through the port and the aperture when they are in registry as a result of relative rotation therebetween. The manifold has an inlet communicating with its axial passageway.

A bearing-block assembly is adapted for mounting in the press. It includes a bearing-block body member having a generally cylindrical bearing recess in one face. The one end of the roll is journaled in the recess of the body member for rotation therein and for substantial retention of the roll in a predetermined axial position in the press. It also has a couplant member seated in the bearing-block body member adjacent the bearing recess, fixed in position axially of the bearing-block body-member recess, and rotatably adjustable in the body member relative to the body-member recess. The couplant member includes an elongated conduit having an axially extending portion that has an outlet communicating with the inlet of the manifold. The elongated conduit further includes a transversely extending portion extending from the axial portion to the periphery of the couplant member. The transversely extending portion has an inlet adapted for fluid communication with a source of pressurized fluid. The couplant member has a fluid coupling at the outlet of the axially extending portion, and the fluid coupling has means thereon about the outlet engaged with the manifold at the inlet thereof to prevent axial rotation of the manifold relative to the fluid coupling but to permit free axial withdrawal of the manifold from the fluid coupling. Coupling of the outlet of the axial portion to the inlet of the manifold provides fluid communication between them and permits fluid flow from the source of pressurized fluid through the conduit, manifold, and aperture to the outside surface of the roll when the inlet of the transversely extending portion communicates with the source of pressurized fluid. Adjustment of the rotational position of the couplant member thereby adjusts the rotational position of the manifold and the rotational position of the roll at which the port and the aperture register with each other.

The couplant member may conveniently include an adjustment cap seated in the bearing-block body member and having a bore therethrough coaxial with the recess of the bearing-block body member. A fluid pipe having axially and transversely extending portions forming the axially and transversely extending portions of the conduit would also be included in the couplant member. The axially extending portion of the fluid pipe would extend through the bore and have the coupling member thereon at the outlet of the conduit. The adjustment cap would include means for preventing rotation and axial movement of the fluid pipe relative to the adjustment cap. Adjustment of the rotational position of the adjustment cap would thereby adjust the rotational position of the manifold and the rotational position at which the port and the aperture register with each other.

Conveniently, a thrust plug secured in the cavity at the other end of the roll abuts the manifold at its other end to prevent axial motion of the manifold in the direction away from the first end of the roll.

In the preferred embodiment, the coupling on the fluid pipe has an axially-extending finger portion, and the manifold has a recess formed therein receiving the finger portion to prevent relative rotational motion between the manifold and the couplant member.

The bearing-block body member preferably includes means thereon operable to hold the ajustment cap in rotational position when the rotational position of the adjustment cap has been adjusted. Such means include an adjustment screw that prevents rotation of the adjustment cap when the screw is tightened but permits rotation of the adjustment cap when the screw is loosened. In the preferred embodiment, the adjustment cap includes a generally disc-shaped cap. The disc-shaped cap has a radial slot extending from its axial bore to its periphery, and the transverse portion of the air pipe is received in the slot. The adjustment cap further includes retention screws threadedly received in the disc-shaped cap on either side of the slot. The retention screws include screw heads extending over the slot to prevent axial removal of the air tube from the slot while the retention screws are in place.

The bearing-block body member has a generally arcuate seating surface in which the disc-shaped adjustment cap is seated. The seating surface is interrupted to leave a recessed surface in the face of the bearing-block body member opposite that in which the cylindrical recess is provided. The recessed surface accommodates the transverse portion of the air pipe during rotation of the air pipe about the axis of its axial portion.

BRIEF DESCRIPTION OF THE DRAWINGS

These and further features and advantages of the present invention are described in connection with the attached drawings, in which.

DETAILED DESCRIPTION OF THE PREFERRED EMBODIMENT

The drawings illustrate a die-cutting roll assembly that includes a novel arrangement of a bearing-block assembly. The bearing-block assembly performs the normal function of a bearing block of conventional design. However, it also includes means for conducting air and adjusting manifold position while solving the problem of transverse air supply.

Figure 1:
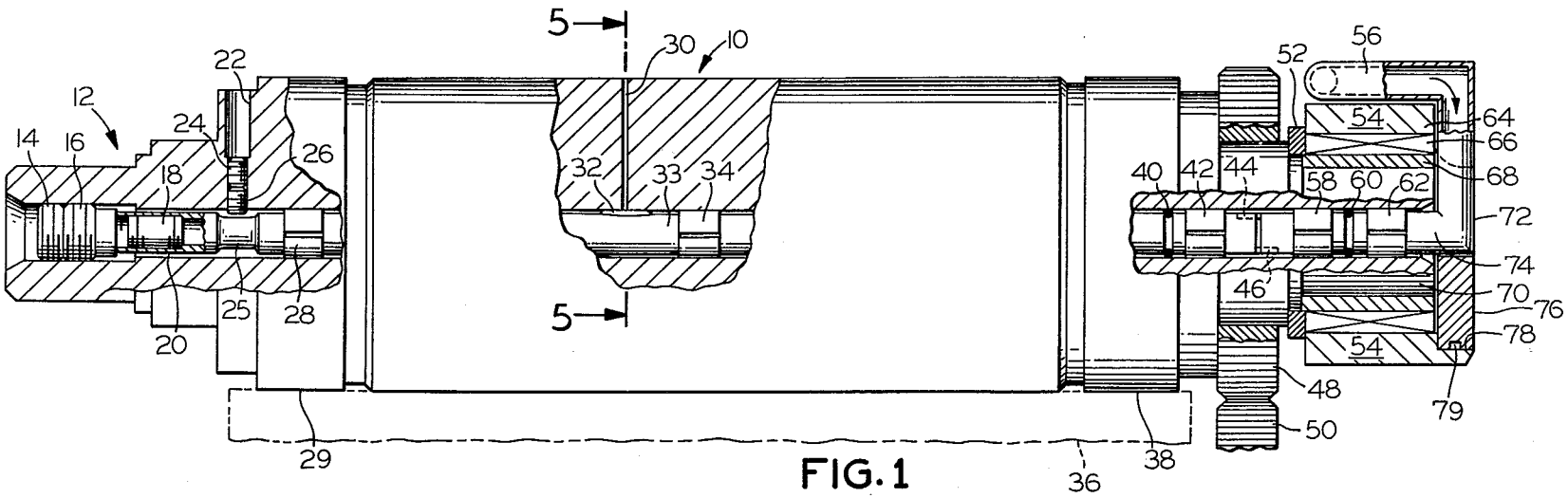
FIG. 1 is a vertical elevation, partly in section, of the die-cutting roll assembly of the present invention.

FIG. 1 shows a die-cutting roll, designated generally by the reference numeral 10, which is journaled in the body portion 54 of a bearing-block assembly at one end and has a mounting means 12 on the other end adapted to be rotatably supported in the press, which is not shown in the drawings. The roll 10 is rotated by means of a gear 50, which is suitably connected to a motor or other means of motivation. The gear 50 engages a gear 48 fixed to the roll 10, and sheet material passing between the roll 10 and an anvil roll 36 is cut by means of cutting surfaces not shown that are present on the surface of roll 10. Proper spacing between roll 10 and anvil roll 36 is maintained by bearer surfaces 29 and 38 on roll 10. The cutting surfaces are of generally closed configuration, and air is supplied interiorly of the cutting surfaces by radial apertures 30 that extend from a central chamber in the die-cutting roll 10 to its outside surface. The air is supplied by means of a stationary manifold 33 that receives air through the couplant member located to the right in FIG. 1 and described in more detail below.

As is described in more detail in U.S. Pat. No. 3,766,814 mentioned above, at least one radially extending port 96 (FIG. 4) in the manifold periodically comes into registration with the aperture 30 in the die-cutting roll 10 to supply air to the outside surface of the die-cutting roll at the position of a cutting surface.

As was mentioned above, the die-cutting roll 10 is journaled in a bearing-block body member 54, which is a block of somewhat rectangular cross section with a generally cylindrical recess in one of its faces in which one end of the roll is received. The wall of the cylindrical recess is designated by the reference numeral 90 in FIG. 3. Integral portion 70 of the roll extends into the recess and has fitted on it needle bearings 66 that enclose a bearing race 68 between the needle bearings 66 and the integral portion 70 of the roll 10. A thrust washer 52 fits around the roll adjacent the needle bearings 66 and overlaps a face of the bearing-block body member 54. It can thus be appreciated that the roll 10 is free to rotate within the bearing-block body member 54.

The integral portion 70 of the die-cutting roll has an extension of the axial chamber of the die-cutting roll. Axial portion 74 of an air tube 56 extends through this axial chamber of the integral portion 70 of the die-cutting roll 10 and terminates in a coupling member that includes a finger 44 that extends into a suitable recess in the manifold 33. The manifold 33 has a similar finger 46 that is received in a corresponding recess in the coupling member that is formed on the end of the axial portion 74 of the air tube 56. Seal rings 40 and 60 fit in annular recesses around the manifold 33 and the axial portion 74 of the air tube, respectively, to form an air tight annulus around the coupling to prevent air from escaping from it Split bushings 58 and 62 flank seal ring 60 and bear on the wall of the axial chamber within the integral portion 70 of the roll. In short, the bearing-block body member 54 and the axial portion 74 of the air tube 56 are stationary, while the needle bearings 66, the inner race 68, and the integral portion 70 all rotate.

Figure 2:
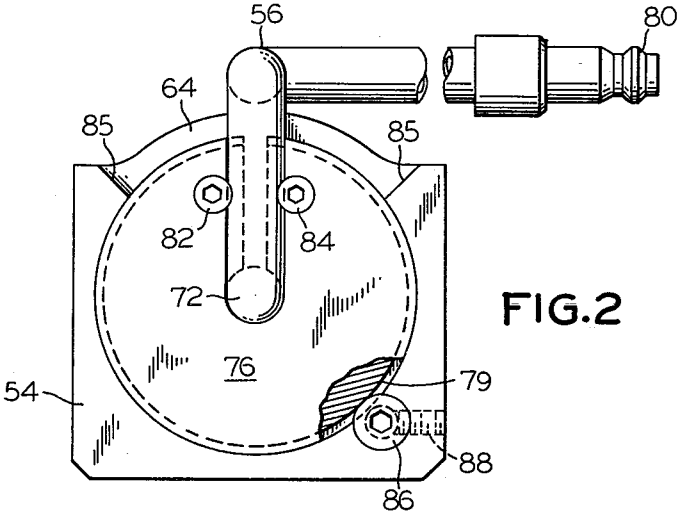
FIG. 2 is a vertical elevation taken from the right end of FIG. 1.
Figure 3:
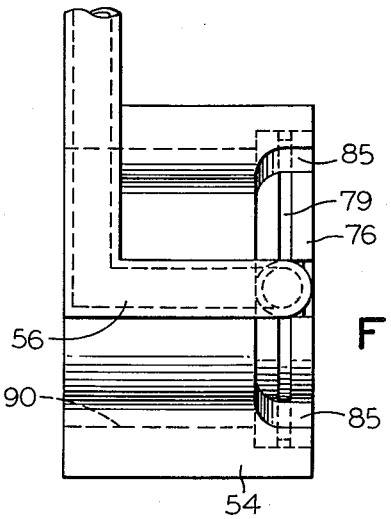
FIG. 3 is a simplified plan view of the bearing-block assembly of the present invention.

Inspection of FIG. 2, FIG. 3, and right-hand portion of FIG. 1 reveals that the air tube 56 continues from the axial portion 74 in a transverse portion 72 that extends to the periphery of the bearing-block assembly. In the embodiment shown here, the air tube 56 continues at right angles to the transverse portion 72 and terminates in a section that is perpendicular both to the axial section and the transverse section, forming a nipple 80 adapted to receive an air hose. Screw heads 82 and 84 (FIG. 2) act as means for holding the air tube in axial and rotational position with respect to an adjustment cap 76 that seats in a seating surface 78 that extends three-quarters of the way around bearing-block body portion 54. The seating surface 78 is interrupted to leave a recessed surface 64. An adjustment shaft 86 having a widened head portion holds the adjustment cap 76 in the desired rotational position. Adjustment is accomplished by loosening a screw 88, which terminates in a conical section that fits into a conical recess in adjustment shaft 86. When screw 88 is loosened, the widened head of adjustment shaft 86 bears less tightly against adjustment cap 76, allowing it to be rotated. As can be appreciated from an inspection of FIG. 1, the transverse portion of air tube 56 rests in a radial slot in adjustment cap 76. Accordingly, surface 64 is recessed to permit the transverse portion 72 of air tube 56 to follow adjustment cap 76. Adjustment is limited by diagonal shoulders 85, which form the bounds of the recessed surface 64. After the rotational position of air tube 56 has been adjusted by rotating adjustment cap 76, adjusting shaft 86 is tightened by tightening screw 88 to hold the adjusting cap in position.

The coupling that includes finger 44 on end of air tube 56 permits withdrawal of the manifold 33 from the air tube 56 in the axial direction, but the rotational position of the air tube 56 is transmitted to the manifold 33 by means of the coupling, so adjustment of the rotational position of the manifold 33 within the die-cutting roll 10 can be accomplished by rotating the adjustment cap 76, which also rotates the air-tube axial portion 74 and thus the manifold 33. The rotational position of the manifold is therefore set once screw 88 has been tightened.

The foregoing description indicates that air tube 56 is held stationary with respect to adjustment cap 76. However, it has been found desirable for some play, particularly in radial position, to be left in the connection between the air tube and the adjustment cap. This allows, for example, for possible eccentricities so that tolerances are not required to be too tight. Accordingly, although the air tube is described as being held stationary with respect to the adjustment cap, it will be understood that some minor relative motion is permissible.

Although the air tube 56 is permitted to be withdrawn from the manifold 33 by the coupling on end of its axial portion, application of air to the manifold does not cause it to withdraw through the opposite end of the die, because a thrust plug 16 is held in an internally threaded portion of the roll at its left end. The thrust plug 16 has a threaded portion and a surface of carbon-impregnated nylon that abuts the left end of the manifold and reduces the friction that would otherwise occur due to the relative rotation of the die-cutting roll and the manifold. Thrust plug 16 is locked in place by a locking screw 14.

The thrust plug is the major means for maintaining the manifold in its axial position within the die-cutting roll, but a retaining screw 26 positioned in a radial bore 22 in the die-cutting roll fits in a recess 25 in the manifold but it is kept relatively loose to avoid wear. Retaining screw 26 is held in place by locking screw 24, and it functions as a back-up means for maintaining the manifold in its axial position. Furthermore, when the roll is removed from the press, the retaining screw 26 prevents the manifold from sliding out of the roll to the right as seen in FIG. 1.

Figure 4:
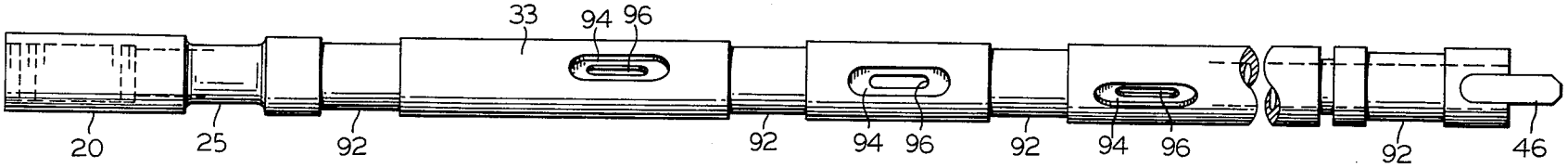
FIG. 4 is a plan view of the manifold of the present invention.
Figure 5:
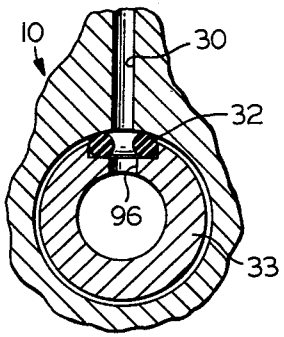
FIG. 5 is a cross-sectional view taken at line 5—5 of FIG. 1.
Figure 6:
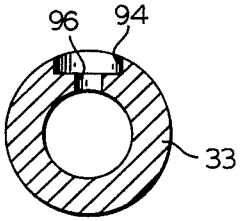
FIG. 6 is the same view as FIG. 5, but with the roll and O-ring removed.

Manifold 33, which is retained in rotational position by fingers 44 and 46 and in axial position by the axial portion 74 of air tube 56 and thrust plug 18, remains stationary while roll 10 rotates. As can be seen in FIG. 4, recesses 92 are provided at intervals along the length of manifold 33, and split bushings 28, 34, and 42 are seated in these recesses. The radially extending ports 96 are spaced along the length of manifold 33 to coincide in axial position with apertures 30 that extend from the interior chamber of the roll to its outside surface. As can be seen in FIGS. 4 and 6, oval recesses are provided around the apertures 96 in the manifold 33, and FIG. 5 shows that a flexible O-ring is seated in the oval recess in order to seal between the manifold 33 and the wall of the interior chamber of the roll 10.

As is described in greater detail in U.S. Pat. No. 3,766,814, the ports 96 in the manifold 33 are offset from each other in rotational position, although the corresponding apertures 30 in roll 10 are not so offset. As a result, registry between all of the ports and all of the apertures does not occur simultaneously, and this maintains an air pressure that is higher than that which would be maintained if the ports and apertures were all to register simultaneously.

From the above description, it can be appreciated that air is provided to the manifold 33 transversely of its axis by means of a couplant that includes the adjustment cap 76 and the air tube 56. This couplant provides air from a transverse direction at the same time that it holds the manifold 33 in a fixed rotational position. Nonetheless, replacement of the roll and manifold can be easily accomplished by withdrawing the roll and manifold to the left of FIG. 1.

Having thus described the invention, we claim:

1. For use in die-cutting press, a die-cutting roll assembly comprising:

a die-cutting roll having a cylindrical cavity extending axially inwardly from one end thereof and having mounting means on the other end thereof adapted to be rotatably supported in the press, said roll having at least one aperture extending generally radially from said cavity to a location on the outside surface of said roll, said aperture enabling fluid flow between said cavity and said outside surface of said roll and comprising substantially the only outlet for fluid from said roll;

a generally cylindrical fluid-delivery manifold extending axially into said cavity from said one end of said roll for relative rotation therebetween, said roll preventing axial motion of said manifold with respect to said roll in the direction away from said one end of said roll, said manifold being dimensioned and configured to seat in said cavity with its outer surface in close proximity to the inner surface of said roll defining the corresponding portion of said cavity, said manifold having an axially extending passageway therein with an outlet comprising at least one generally radially extending port opening at a point on said outer surface thereof in a location for registry with said one aperture of said roll to permit fluid flow through said port and said aperture when in registry as a result of relative rotation therebetween, said manifold having an inlet communicating with said axial passageway thereof; and a bearing-block assembly adapted for mounting in the press and including:

(i) a bearing-block body member having a generally cylindrical bearing recess in one face thereof, said one end of said roll being journaled in said recess of said body member for rotation therein and for substantial retention of said roll in a predetermined axial position in the press, and (ii) a couplant member seated in said bearing-block body member adjacent said bearing recess, fixed in position axially of said bearing-block body-member recess, and rotatably adjustable in said body member relative to said body-member recess, said couplant member including an elongated conduit having an axially extending portion that has an outlet communicating with said inlet of said manifold, said elongated conduit further including a transversely extending portion extending from said axial portion to the periphery of said couplant member, said transversely extending portion having an inlet adapted for fluid communication with a source of pressurized fluid, said couplant member having a fluid coupling at said outlet of said axially extending portion, said fluid coupling having means thereon about said outlet engaged with said manifold at said inlet thereof to prevent axial rotation of said manifold relative to said fluid coupling but to permit free axial withdrawal of said manifold from said fluid coupling, coupling of said outlet of said axial portion to said inlet of said manifold providing fluid communication between them and permitting fluid flow from the source of pressurized fluid through the conduit, manifold, and aperture to the outside surface of said roll when said inlet of said transversely extending portion communicates with the source of pressurized fluid, adjustment of the rotational position of said couplant member thereby adjusting the rotational position of said manifold and the rotational position of said roll at which said port and said aperture register with each other.

2. The die-cutting roll assembly of claim 1, wherein said couplant member includes:

an adjustment cap seated in said bearing-block body member and having a bore therethrough coaxial with said recess of said bearing-block body member; and a fluid pipe having axially and transversely extending portions forming said axially and transversely extending portions of said conduit, said axially extending portion of said fluid pipe extending through said bore and having said coupling member thereon at said outlet of said conduit, said adjustment cap including means for preventing rotation and axial movement of said fluid pipe relative to said adjustment cap, adjustment of the rotational position of said adjustment cap thereby adjusting the rotational position of said manifold and the rotational position at which said port and said aperture register with each other.

3. The die-cutting roll assembly of claim 2, wherein said roll includes a thrust plug secured in said cavity at said other end of said roll and abutting said manifold at said other end thereof to prevent axial motion of said manifold in the direction away from said first end of said roll.

4. The die-cutting roll assembly of claim 3, wherein said coupling on said fluid pipe has an axially-extending finger portion, and said manifold has a recess formed therein receiving said finger portion to prevent relative rotational motion between said manifold and said couplant member.

5. The die-cutting roll assembly of claim 2 wherein said bearing-block body member includes means thereon operable to hold said adjustment cap in rotational position when the rotational position of said adjustment cap has been adjusted.

6. The die-cutting roll assembly of claim 5 wherein said means on said bearing-block body member operable to hold said adjustment cap in rotational position includes an adjustment shaft with an enlarged head portion that prevents rotation of said adjustment cap when said head portion bears tightly against said adjustment cap.

7. The die-cutting roll assembly of claim 2 wherein said adjustment cap includes a generally disc-shaped cap.

8. The die-cutting roll assembly of claim 7 wherein said disc-shaped cap has a radial slot extending from its axial bore to its periphery, said transverse portion of said air pipe being received in said slot, said adjustment cap further including retention screws threadedly received in said disc-shaped cap on either side of said slot, said retention screws including screw heads extending over said slot to prevent axial removal of said air tube from said slot while said retention screws are in place, said means on said adjustment cap for preventing rotation and axial movement of said fluid pipe including said slot and said retention screws.

9. The die-cutting roll assembly of claim 7 wherein said bearing-block body member has a generally arcuate seating surface in which said disc-shaped adjustment cap is seated, said seating surface being interrupted to leave a recessed surface in the face of said bearing-block body member opposite that in which said cylindrical recess is provided that accommodates said transverse portion of said air pipe during rotation of said air pipe about the axis of its axial portion.

* * * * *